US005602746A

United States Patent [19]

Löffler

[11] Patent Number: 5,602,746

[45] Date of Patent: Feb. 11, 1997

[54] METHOD OF DRYING PRINTING MATERIAL

[75] Inventor: Gerhard Löffler, Walldorf, Germany

[73] Assignee: Heidelberger Druckmaschinen AG, Heidelberger, Germany

[21] Appl. No.: 379,715

[22] Filed: Jan. 27, 1995

[30] Foreign Application Priority Data

Jan. 27, 1994 [DE] Germany ..... 44 02 338.3

[51] Int. Cl.[6] ..... B41F 5/06

[52] U.S. Cl. ..... 364/469.01; 364/471.01; 364/471.03; 101/486; 101/DIG. 36; 382/111

[58] Field of Search ..... 364/471, 468, 364/469; 162/198, 263; 101/180–181, 211, 485, 486, DIG. 36; 226/2, 3, 15–18, 27–28, 45; 382/112, 165, 111, 294

[56] References Cited

U.S. PATENT DOCUMENTS 4,433,385 2/1984 De Gasperi et al. .
4,698,767 10/1987 Wensel et al. ..... 364/471
4,701,857 10/1987 Robinson ..... 364/471
4,777,604 10/1988 Robinson ..... 364/471
5,011,573 10/1991 Niemi ..... 364/471
5,500,801 3/1996 Loffler ..... 364/469

FOREIGN PATENT DOCUMENTS 3-193450 8/1991 Japan .
4-371843 12/1992 Japan .

*Primary Examiner*—Roy N. Envall, Jr.
*Assistant Examiner*—Thomas E. Brown
*Attorney, Agent, or Firm*—Herbert L. Lerner; Laurence A. Greenberg

[57] ABSTRACT

It is the object of the invention to provide a printing method permitting a high printing quality and reducing the influences of the forces and fields acting on the printing material. The object is achieved in that, by means of two image-detecting arrangements disposed in the transport path of the printing material, image signals are obtained before and behind a device treating the surface of the printing material and are supplied to a control unit, and in that the changes of the outer dimensions are quantitatively determined on the basis of said image signals. The invention may be applied on printing machines.

6 Claims, 3 Drawing Sheets

METHOD OF DRYING PRINTING MATERIAL

BACKGROUND OF THE INVENTION

Field of the Invention

The invention relates to a method of drying printing material in a printing machine.

The invention relates to a printing method according to which a printing material is conveyed through a printing machine, with the printing material being subjected to mechanical forces and influenced by devices treating the surface of the printing material. Especially dampening devices, drying devices, or cooling devices cause the outer dimensions of the printing material to change. The devices are adjusted manually, or they are connected to a control unit permitting an automatic control of the temperature of the drying devices or cooling devices, for example, or of the dampness of dampening devices as a function of the printing speed. For this purpose measuring sensors, in the form of temperature sensors or dampness sensors, are assigned to the respective devices.

Furthermore, it is known to inspect the surface of a printing material by means of an image-detecting unit after it has passed through a printing machine. The image signals are supplied to a control unit in which adjusting signals for operational processes are generated, the adjusting signals being directly supplied to the ink-metering elements, the devices providing dampening medium, and the register-adjusting devices. This ensures a high printing quality, but the changed outer dimensions are not taken into account.

SUMMARY OF THE INVENTION

It is the object of the invention to provide a printing method ensuring a high printing quality and reducing the influences of the forces and fields acting on the printing material.

The object is achieved in that, by means of two image-detecting arrangements disposed in the conveying path of the printing material, image signals are obtained before and behind a device treating the surface of the printing material and supplied to a control unit, and in that the changed outer dimensions are determined quantitatively on the basis of the image signals.

An advantage of the invention is in the fact that information in the form of image signals, on the changed outer dimensions is available in two dimensions; when evaluating the image data obtained from a respective printed motif, the gradient of change with respect to the transport direction of the printing material and transversely thereto may be taken into account, provided that the changes in length differ very much across a respective print. This applies especially to motifs featuring an extremely differing ink distribution.

The measured values of the coordinate-dependent changes of the dimensions may be supplied to the operator of the printing machine directly or be displayed as adjusting recommendations. Thus, the operator may obtain information on as to how much the temperature of a thermo drying device disposed in the transport path is to be reduced, given a certain amount of contraction of the dimensions of the printed image, for example, or as to how much the speed of the printing machine is to be slowed down.

Furthermore, the measured values representing the mean coordinate-dependent changes of the dimensions may be taken into account when making the printing form, by producing the halftone dots such that the print-dependent changes in length and width can be compensated for. Especially with devices imaging the printing form within the printing machine, the individual properties of the printing machine and the devices treating the surface can be taken into account with respect to the location of a halftone dot to be produced.

According to another modification the coordinate-dependent changes of the dimensions can be processed in the control unit by controlling, for example, the temperature of a thermo-drying device without any interference on the part of the operator, or by controlling the speed of the printing material as a function of the measured values obtained, the amount of contraction being reduced and kept constant during the entire print run.

The method proves to be especially advantageous when applied on devices for surface treatment, the devices making it possible to locally influence the surface of the printing material. Thus, a motif-dependent temperature gradient may be controlled on the basis of the measured values.

With the foregoing and other objects in view, there is provided, in accordance with the invention, a method for treating printing material, according to which the printing material is conveyed through a printing machine by conveying means, and according to which, there is provided a device for treating the surface of the printing material, the surface-treating device being disposed in the transport path and effecting changes of the outer dimensions of the printing material, the method includes:

obtaining, by means of at least one image-detecting arrangement, image signals from at least one surface of the printing material, wherein the image signals are processed within a control unit controlling the operational processes influencing the printed image, obtaining, by means of two image detecting arrangements, image signals in the transport path before and behind the surface-treating device for the surface of the printing material, and determining quantitatively by means of the control unit the required changes of the outer dimensions on the basis of the image signals.

In accordance with another feature of the invention, there is provided a method for treating printing material, which further includes connecting a printing machine display unit to the control unit, selecting by the operator of the printing machine display the determined amount of contraction of the print dimensions, by which the temperature of a thermo-drying device disposed in the transport path is to be reduced in order to minimize the contraction, or the necessary change in speed of the printing material.

In accordance with a further feature of the invention, there is provided a method for setting, as a function of the amount of contraction of the printing material, adjusting elements of a thermo-drying device and adjusting elements responsible for the conveying speed which are influenced automatically through the the control unit.

The printing method according to the invention may, further include taking into account, when making the printing form, the mean changes of the outer dimensions, and producing the halftone dots so as to compensate for the changed outer dimensions.

In accordance with a concomitant feature of the invention, there is provided a method for producing in a printing machine, in which the obtained image is printed by means of a computer-controlled imaging unit within the printing machine, imaging data, and compensating the printed image for the mean changes of the outer dimensions.

Other features which are considered as characteristic for the invention are set forth in the appended claims.

Although the invention is illustrated and described herein as embodied in a method of drying printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
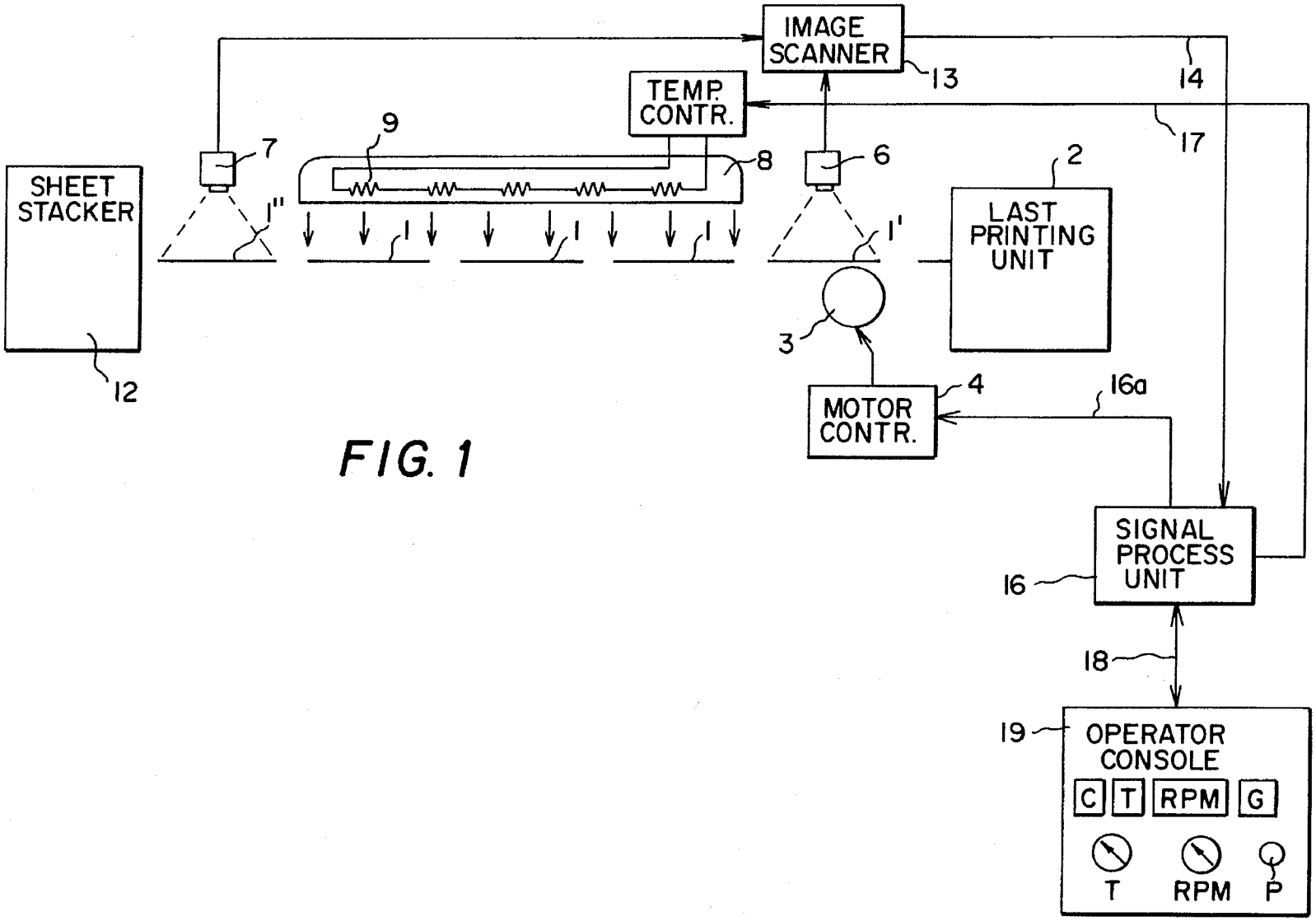
FIG. 1 is an overall diagram of a drying arrangement.

The invention is explained in greater detail with reference to a exemplary embodiment:

In a sheet-fed offset printing machine running at high speed the sheets, after having been printed with different inks, are to pass through a thermo-drying device before being deposited on a pile. Image-detecting arrangements each detecting the entire printed sheet surface are disposed in the transport path of the sheets behind the last printing unit and the thermo-drying device. Said image-detecting arrangements are connected to a control unit which, inter alia, is connected to adjusting elements of a drive system, temperature-adjusting elements of the thermo-drying device and display elements displaying the thermo-drying temperature and the machine speed.

The sheets, when being printed and conveyed, are changed as to their dimensions due to the application of ink and dampening medium as well as due to the forces of the conveying means acting on the sheets and the thermal field in the thermo-drying device. Those changes may be detected by means of the image-detecting arrangement by supplying the image signals to the control unit where they are processed. A plurality of measuring lengths may be compared on the sheet surface before and after the thermal treatment, with the measured lengths lying advantageously in sheet-conveying direction and transversely thereto. The measured lengths may be obtained from image signals which are directly provided by the printed image or specific length-measuring marks. According to a simple modification only the lengths and widths of the sheets the measured values which are obtained from the image signals are compared, those image signals resulting from the detection of the sheet edges. For this purpose measuring values may be obtained at several measuring locations in order to improve the measuring accuracy in view of untidy and faulty sheet edges.

Within the control unit the differences of the measured lengths before and after the thermal treatment are processed into adjusting variables for the temperature of the thermo-drying device and the speed of the sheet-fed printing machine and are automatically supplied to the adjusting elements for adjusting the temperature and the speed. In so doing, it is ensured that the amount of contraction of the sheets is reduced and/or remains constant during the entire print run. At the same time, the differences of the measuring values may be displayed on the display elements.

It is also possible to compute adjusting recommendations for the temperature of the thermo-drying device and the speed of the sheet-fed printing machine on the basis of the differences of the measured values and to display the adjusting recommendations, leaving it up to the operator to apply the adjusting recommendations or to modify them, if necessary.

The measured contraction data may be stored as a function of the temperature of the thermo-drying device and the speed of the sheet-fed printing machine and be statistically evaluated. That information may be used when making the printing form by taking into account and compensating for, at pre-press stage, the average contraction values to be expected when imaging a printing form.

In FIG. 1 printed sheets 1 are leaving a last printing unit 2 of the printing machine, and are transported by conveying means of conventional construction, the details of which are therefore not shown. The conveying means are driven by a motor 3, controlled by a motor control 4. The motor 3 may be the drive motor for the printing machine. Two image pick-up devices 6 and 7 are arranged respectively over a print 1' just leaving a last printing unit 2, and a sheet 1", just emerging from the dryer 8. The dryer 8 has a plurality of heating elements 9, energized by a temperature control 11, which radiate heat onto the sheets 1 as indicated by arrows, as the sheets 1 move in direction from the printing unit 2 to a sheet stacker 12.

As the sheets move under the dryer 8 they contract in size. The degree of contraction is, as stated above, a function of both the speed of the motor 3 and the temperature of the dryer 8.

Each image pickup 6 and 7 can be realized, for example, in the form of a conventional video camera which generates an electrical reproduction of the image on sheets 1' and 1" within the field of view of the image pickups 6, 7, i.e. an electrical image is generated of the printed image on each sheet 1' and 1". The precise dimensions of the printed images on sheets 1' and 1" can be determined from the electrical images with the aid of an image scanner 13 which drives the electron beam in each image pickup 6, 7.

As stated above, markings in the form of measuring lengths, can be placed on the printing sheet which facilitate the measuring of the sheet dimensions in direction of the length and the width of the sheet. The dimensions can also be determined directly from the printed images.

Figure 2:
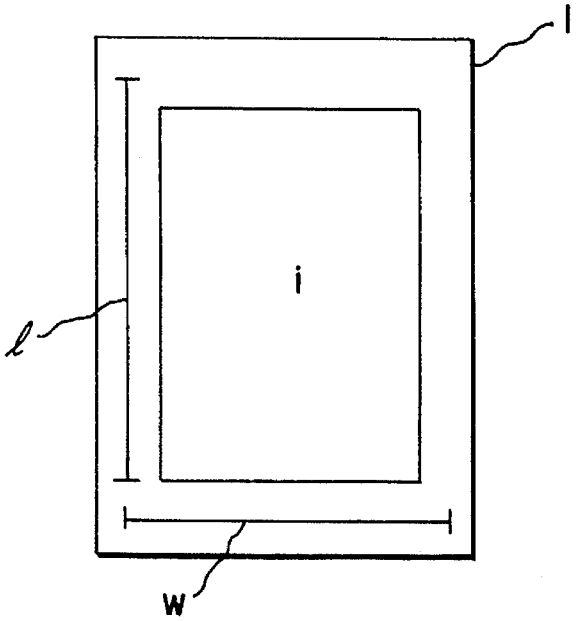
FIG. 2 is a view of a printed sheet with an image and measuring marks thereon.

FIG. 2 shows a sheet 1 having an image i printed, thereon, and two measuring marks w and l printed outside the image field for measuring, respectively, width and length of the sheet, which can be determined by means of the known ratio between the mark w and the actual width of the sheet, and the length of mark 1 and the actual length of the sheet.

The image scanner 13 is connected via a data line 14 to a signal processing unit 16, which is advantageously a conventional process computer adapted for processing the image signals, and which generates control signals for controlling the speed of the motor 3 by means of motor control 4 receiving speed control signals via data line 16*a*, and/or the drying temperature of the dryer 8, which is controlled by the temperature controller 11, which in turn receives temperature control data via data line 17.

It follows that the speed of drying can be increased by reducing the speed at which the sheets 1 are moving under the dryer 8, or by increasing the temperature of the heating elements 9. Details of the construction of the motor controller 4, and the temperature controller are well known from conventional control knowledge. The settings of the temperature and the motor rpm can be obtained from tables stored in the signal processing unit 16, either automatically or under control of a machine operator who has access to the data for contraction of the sheet as determined via the image scanner, and displayed as a contraction figure c on an operator console 19 connected to the signal processing unit 16. The operator console also has displays for the temperature T of the dryer 8, and the rpm of the motor 3, and of the temperature gradient G. The operator can advance or retard both temperature and/or the rpm by means of controls T and RPM, also shown on console 19. A switch P can be operated to display proposed temperature and/or rpm values, as obtained from the tables 27, if desired by the operator.

Figure 3:
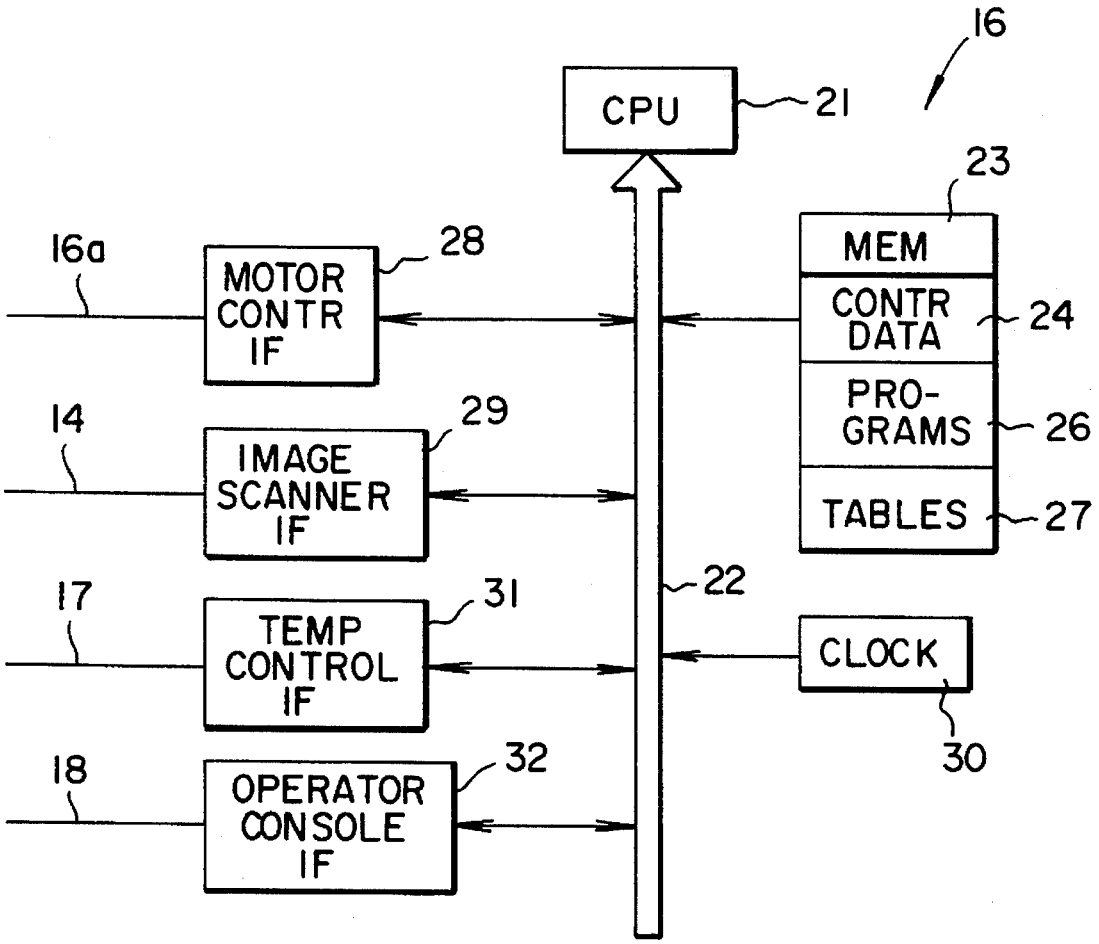
FIG. 3 is a block diagram of the signal processing unit.

FIG. 3 shows details of the signal processing unit 16, which includes a central processing unit CPU 21 of conventional construction, connected via an internal data bus 22 with a memory 23. The memory 23 has a section 24 for storing control data, a program section 26 for storing control programs, and a table section 27 for storing temperature and rpm values as a function of the measured contraction of the printed sheets 1 as measured by the image pick up's 6 and 7. Interface circuits 28, 29, 31, and 32 are respectively providing the necessary interface functions required for the motor control 4, the image scanner 29, the temperature control 31, and the operator console 32. The computer also has a clock 30 which drives the CPU 21 and provides clock pulses for determining gradients of contraction.

Figure 4:
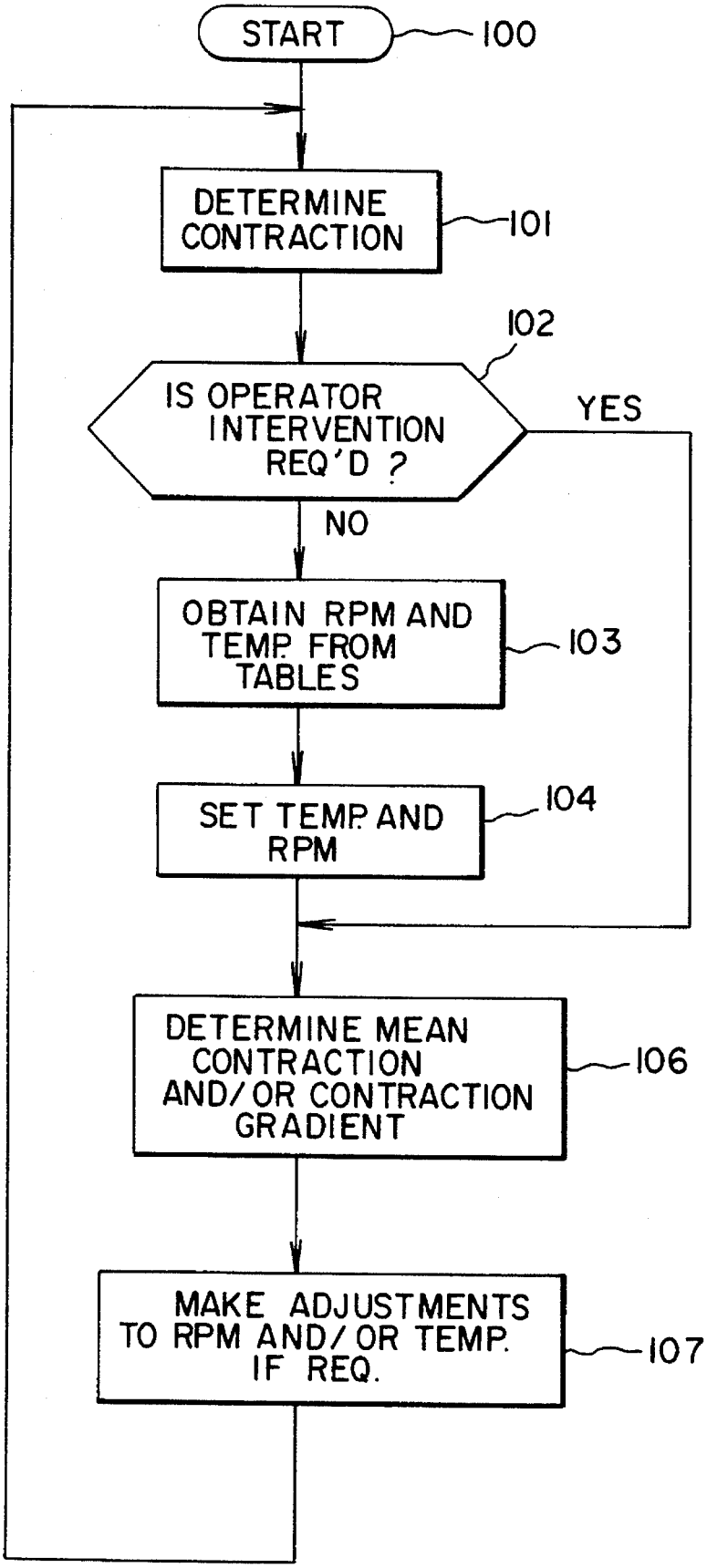
FIG. 4 is a flow chart showing the major step of the printing process according to the invention.

FIG. 4 is a flow chart showing the steps to be performed by the signal processing unit 16. After start 100, the amount of contraction of a sheet from sheet position 1' to 1" is determined in step 101. If the amount of contraction is within standard values as obtained from the tables 27 no operator intervention is required. If intervention is not required, the temperature and RPM remain as indicated in the tables. If intervention is required, the operator may determine the contraction and/or the contraction gradient, i.e. the speed of contraction per unit of time, in step 106 and make adjustments as deemed to be appropriate in step 107, from which the process is repeated in step 101 and so on, until the printing is terminated.

I claim:

1. Method for treating printing material, according to which the printing material is conveyed through a printing machine by conveying means, according to which, there is provided a device for treating the surface of the printing material, the surface-treating device being disposed in the transport path and effecting changes of the outer dimensions of the printing material, the method which comprises:

obtaining, by means of two image detecting arrangements, image signals in the transport path before and behind the surface-treating device for the surface of the printing material, processing the image signals within a control unit controlling the operational processes influencing the printed image, and determining quantitatively with the control unit the required changes of the outer dimensions on the basis of the image signals.

2. Method for treating printing material according to claim 1, further comprising connecting a printing machine display unit to the control unit, selecting by the operator of the printing machine display the determined amount of contraction of the print dimensions, by which the temperature of a thermo-drying device disposed in the transport path is to be reduced in order to minimize the contraction, or the necessary change in speed of the printing material.

3. Method according to claim 1, further comprising setting as a function of the amount of contraction of the printing material, adjusting elements of a thermo-drying device and adjusting elements responsible for the conveying speed which are influenced automatically through the the control unit.

4. Printing method according to claim 1, further comprising taking into account when making the printing form, the mean changes of the outer dimensions, and producing the halftone dots so as to compensate for the changed outer dimensions.

5. Printing method according to claim 4, further comprising producing in a printing machine in which the printed image is obtained by means of a computer-controlled imaging unit within the printing machine imaging data, and compensating the printed image for the mean changes of the outer dimensions of the printing material.

6. A method for treating printing material, which comprises:

conveying a printing material along a transport path through a printing machine;

treating a surface of the printing material with a surface-treating device disposed in the transport path, and effecting changes of the outer dimensions of the printing material in the treating step;

obtaining, by means of two image detecting arrangements, image signals in the transport path respectively before and behind the surface-treating device for the surface of the printing material;

processing the image signals within a control unit controlling the operational processes influencing the printed image; and determining quantitatively with the control unit the changes of the outer dimensions on the basis of the image signals.

* * * * *